United States Patent [19]

Mack

[11] Patent Number: 4,647,755

[45] Date of Patent: Mar. 3, 1987

[54] HEATING DEVICE FOR RAPIDLY HEATING A SINGLE HAIR ROLLER

[75] Inventor: William Mack, Commack, N.Y.

[73] Assignee: Clairol Incorporated, New York, N.Y.

[21] Appl. No.: 723,024

[22] Filed: Apr. 15, 1985

[51] Int. Cl.[4] ..... H05B 1/02; A45D 2/36; A45D 4/12

[52] U.S. Cl. ..... 219/222; 132/11 R; 132/33 R; 219/240; 219/242; 219/354; 219/358; 219/518

[58] Field of Search ..... 219/222–226, 219/240, 242, 354, 518, 220, 358; 132/33 R, 33 G, 37 R, 36 R, 31 R, 32 R, 11 R, 9

[56] References Cited

U.S. PATENT DOCUMENTS

| | | | |
|---|---|---|---|
| 952,941 | 3/1910 | Perkins | 219/521 X |
| 2,262,506 | 11/1941 | Levandowski | 219/242 X |
| 2,666,128 | 1/1954 | Crawford et al. | 219/518 X |
| 2,708,796 | 5/1955 | Adamy | 219/242 X |
| 3,401,256 | 9/1968 | Siegla | 219/354 X |
| 3,486,000 | 12/1969 | D'Elia et al. | 219/222 |
| 3,519,792 | 7/1970 | Solomon | 219/242 X |
| 3,519,793 | 7/1970 | Solomon | 219/220 X |
| 3,892,943 | 7/1975 | Van Droogenbroek | 219/242 X |
| 4,101,756 | 7/1978 | Yamano | 219/242 X |

*Primary Examiner*—Anthony Bartis
*Attorney, Agent, or Firm*—Gene Warzecha

[57] ABSTRACT

A portable hairsetter appliance for heating a single hair roller. The hairsetter comprises a cylindrical housing having an axially aligned and longitudinally extending high voltage electric resistance heating element encapsulated in a quartz envelope for heating a single hair roller inserted into the cylindrical housing. The weight of the roller closes an electrical circuit and the roller is heated to a predetermined temperature whereupon a thermoplastic bimetallic disc changes its concavity to open the electrical circuit. A safety means is provided to automatically open the electrical circuit if the roller is pressed into the housing with a force greater than its own weight.

3 Claims, 11 Drawing Figures

FIG. 6
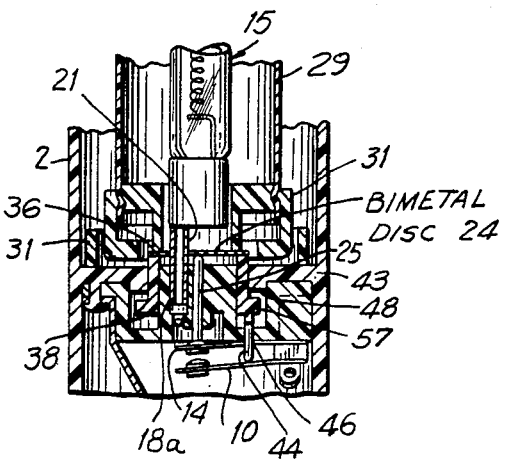
FIG. 7
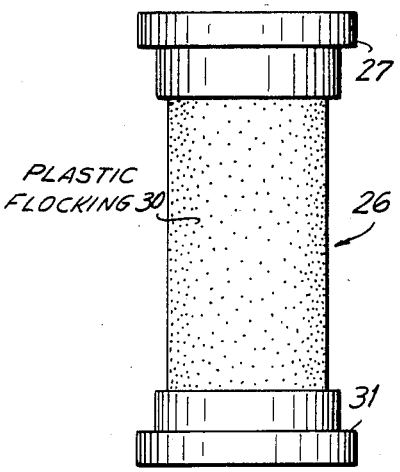
FIG. 8
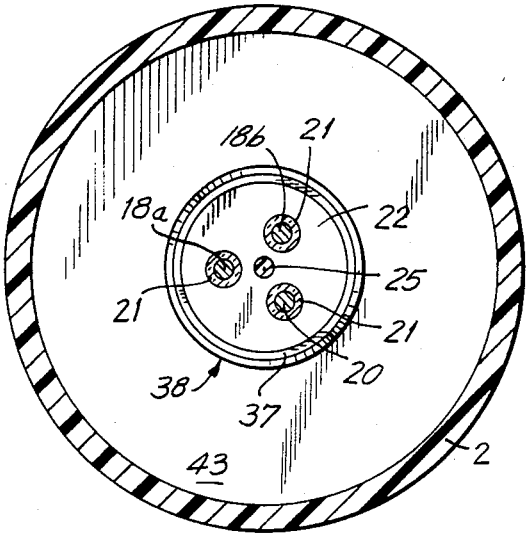
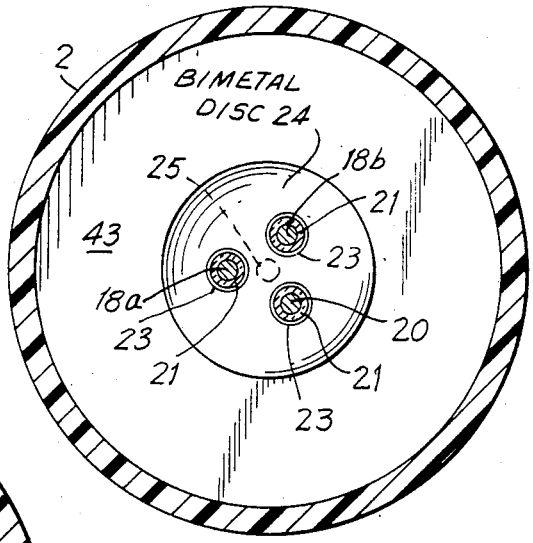
FIG. 9
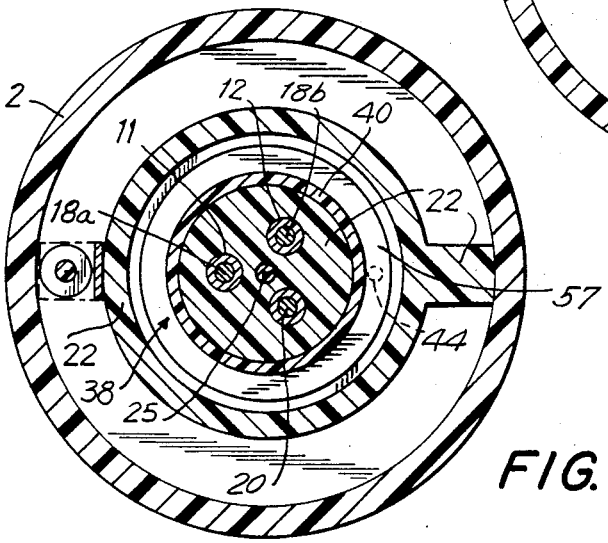
FIG. 10

HEATING DEVICE FOR RAPIDLY HEATING A SINGLE HAIR ROLLER

BACKGROUND OF THE INVENTION

1. Field of the Invention

The invention relates to hairsetter or hair roller heating devices that enable a user to heat hair rollers. More particularly, it relates to a portable hairsetter roller heating device that enables the user to rapidly heat one roller at a time.

2. Description of the Prior Art

There are available numerous types of hair roller heating devices all generally known as "hairsetters." These devices basically use the principle of imparting heat to a plurality of hair rollers simultaneously, the rollers being mounted on a like number of heated posts. By experience, many manufacturers have determined that 20 heated posts will supply a sufficient number of heated rollers for a single hair-setting. This arbitrary requirement, however, produces a hairsetter of relatively large proportions and correspondingly large cost. Moreover, such a device is not generally regarded as being portable, that being a specific limitation. In an effort to provide the feature of portability to hairsetters, units have been produced which contain as few as 4 rollers, each of such hairsetters contains an integral electrical heating means of sufficient wattage as to be able to supply heated rollers on demand at a rate approximating the average user's needs. While this type of hairsetter may be regarded as being compact for portability, it is not inexpensive owing to the fact that each roller is provided with a separate heating element and an electrical connection. The subject invention, however, ovecomes the foregoing problems of non-portability and high cost.

SUMMARY OF THE INVENTION

The disadvantages of the prior art are provided by providing a hairsetter device which is adapted to rapidly heat a single, individual roller. This device comprises a cylindrical housing that is dimensioned to receive a single roller at a time. The housing is provided with an axially disposed heating means which comprises a high wattage resistance element encapsulated in a quartz envelope. Means are provided in the housing for electrically energizing the heating means. The energizing means activates the heating means when a roller is placed in the housing. In the preferred form of this invention, the weight of the roller is sufficient to push the heating means home so that the latter can be electrically energized.

A thermostatically sensitive bimetallic disc is interposed between the roller and a switch such that the energizing means is deactivated when the disc flips to its alternate state. A safety member is interposed between the bimetallic disc and a switch in order to deactivate the energizing means if the roller is pushed down into the housing beyond a predetermined point.

BRIEF DESCRIPTION OF THE DRAWINGS

The invention will be further described with respect to the attached drawings wherein:

FIG. 6 is a fragmentary vertical cross section similar to FIG. 2 showing the position of the bimetallic thermostatic disc and switch elements after the hair roller has been heated, illustrating the safety feature built into the switch elements when the roller is forced downwardly.

FIG. 7 is a diagrammatic view of the hair roller employed in the present invention.

FIG. 8 is a sectional view of FIG. 5 taken along the line 8—8.

FIG. 9 is a sectional view of FIG. 5 taken along the line 9—9.

FIG. 10 is a sectional view of FIG. 4 taken along the line 10—10.

DESCRIPTION OF THE PREFERRED EMBODIMENT

Figure 1:
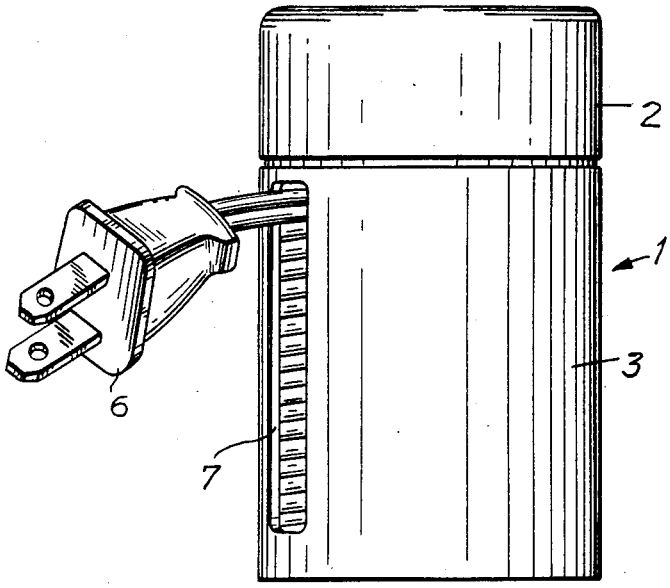
FIG. 1 is a diagrammatic, front elevational view of a device embodying in the present invention.

Referring in detail to the drawings, 1 designates generally a hairsetter assembly comprising in part a two-piece casing having sections 2 and 3, the former fitting into the latter in a telescopic relationship. An electrical line cord 4 may helically and/or retractably wind up in a single layer in the annular space 5 formed between cylindrical walls of casing members 2 and 3. Bottom wall **3*a* of casing member 3 is connected via link 3*b* to casing member 2. Link 3*b* is secured to wall 3*a* by screw 3*c* and to casing 2 by integral stud 3*d* depending from wall 43. The plug end 6 of line cord 4 emerges from a vertical slot 7 cut through the outer wall of casing member 3. The other end of 2-conductor line cord 4 passes through a narrow opening 8 in the lowermost portion of casing member 2. One line of line cord 4 passes inwardly to be permanently connected to solder lug 9 on lower electrical contact member 10. The other line of line cord 4 is permanently connected to heater contact pin receptacle 11. Another heater contact pin receptacle 12 best seen in FIG. 10 is electrically connected by conventional means (not shown) to upper, flexible electrical contact member 14**.

Heater 15 is comprised of a high wattage resistance element 16 encapsulated in quartz envelope 17 having the electrical leads that terminate in a pair of contact pins **18*a* and 18*b*. The latter depend from heater base 19 to plug into contact pin receptacles 11 and 12. A third insulated support pin 20 (best seen in FIGS. 8, 9 and 10) is also anchored into heater base 19 to aid the physical stability of the heater 15. Contact pins 18 and the support pin 20 are of equal dimensions and of equidistant angular spacing in their heater base mounting 19. The pair of pins 18*a* and 18*b* and support pin 20 are aligned with, and plug into three high temperature ceramic receptacle posts 21 which are force fitted into holes bored through fitting member 22 entrapping contact pin receptacles 11 and 12**.

Figure 3:
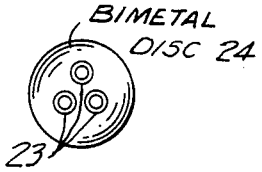
FIGS. 3 and 3A are a plan and profile view of a bimetallic thermostatic disc which constitutes part of this invention.
Figure 3A:
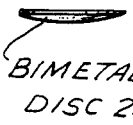

Three round, equally spaced, apertures 23 (best seen in FIG. 3) are provided in concave bimetallic temperature actuated snap disc 24. These fit loosely over ceramic receptacles posts 21, and permit the center of disc 24 to rest against slidable pin 25. Pin 25 is axially slidably positioned in a hole provided in the center of member 22. The lower end of pin 25 rests against the upwardly spring loaded electrical contact member 14.

Hairsetter roller 26 comprises an upper end cap 27 made of a plastic material which is affixed securely to the heavy (heat-retaining) closed end 28 of cylindrical aluminum body 29. Aluminum body 29 may have its external cylindrical surface provided with plastic flocking 30. A lower end cap 31 made of a plastic material is securely affixed to the external surface of the open end of cylindrical body 29. Affixed to the interior surface of cylindrical body 29 is aluminum end cap member 32 which terminates downwardly in a tubular configuration 33 having a through-bore 34 slightly larger in diameter than the quartz envelope 17 and base 19 of heater 15. This allows roller 26 to be positioned over heater assembly 15.

A circular recess 47 is provided which is centered on the inside of closed end 28 of cylindrical body 29 and which has a tapered (conical) lead-in 35 of slightly larger diameter than quartz envelope 17 so as to guide closed end 28 to a concentric position relative to heater 15 when roller 26 is mounted on heater 15. Annular end 36 of tube 33 is beveled outwardly as to approximately match the concavity of bimetallic snap disc 24 (at the portion of the disc contiguous with end 36) so that when the roller is positioned on the heater, tube end 36 will make intimate contact with disc 24.

It will be understood that the roller for use with hairsetter 1 may alternatively be provided with a conventional internal cylindrical container having a longitudinal bore (to enable it to be placed on heater 15) and filled with a heat-retaining material. One example of such a roller may be seen in U.S. Pat. No. 3,773,057.

Figure 2:
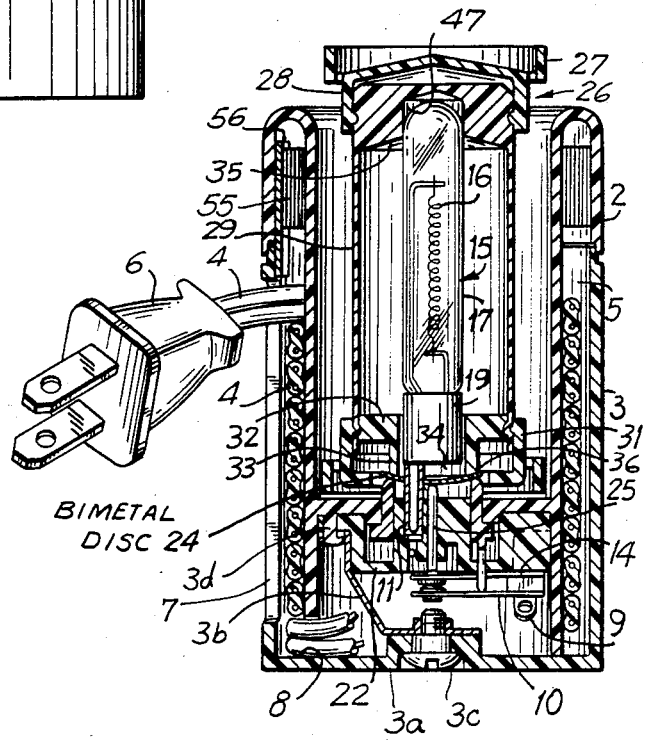
FIG. 2 is a median vertical cross sectional view of the device shown in FIG. 1 with the hair roller in place at the start of the roller heating cycle.

As will be noted in FIG. 2, the weight of the hair roller bearing upon disc 24 rests upon free-sliding pin 25. The latter bears upon upper electrical contact 14 depressing it against restrained lower contact 10 to complete the electrical circuit to energize heater 15.

A tubular plastic member 38 having an upper annular edge surface 37 is axially slidably mounted between a circular bore 39 (in a transverse wall 43 in casing 2) and cylindrical portion 40 of member 22. A depending integral pin 44 is provided at the lower edge of tubular member 38. Pin 44 passes freely through hole 45 in member 22, and hole 46 in contact 14. Resting on upper surface of contact 10, integral pin 44 transmits the upward spring loading action of contact 10 through pin 14 to bias flange 57 of tubular member 38 against circular ledge 48 of transverse wall 43. In normal operation the weight of roller 26 is such that a clearance gap 42 exists between roller end cap 31 and transverse wall 43.

Figure 5:
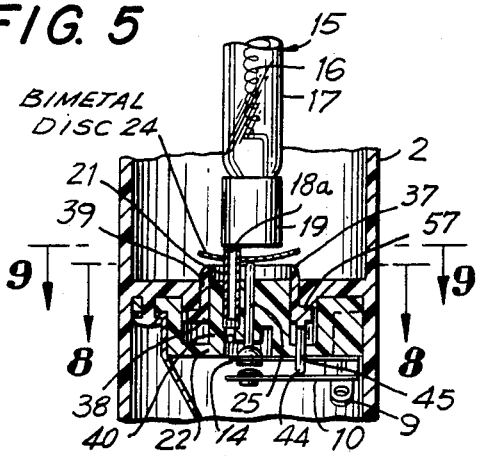
FIG. 5 is a fragmentary vertical cross section similar to FIG. 2 showing the position of the bimetallic thermostatic disc and switch elements with the hair roller removed, after cooldown of the thermostatic disc.

The relationship of the parts of hairsetter 1 before a hair roller is inserted into it is best seen in FIG. 5. Bimetallic snap disc 24 is in the dished-upward or concave position. Since the weight of roller 26 is not present to press downwardly against sliding pin 25, the latter is urged upwardly by spring loaded flexible contact member 14. This breaks the contact that the latter may have with lower electrical contact member 10 thus opening the electrical circuit and preventing the energizing of heater 15.

When roller 26 is first placed into the heating device, the parts assume the relationship best seen in FIG. 2. The weight of roller 26 pushes pin 25 downwardly which in turn pushes electrical contact 14 into engagement with electrical contact 10. This completes the electrical circuit and the heater is energized. At this point, bimetallic snap disc 24 is still in the dished upward position.

Figure 4:
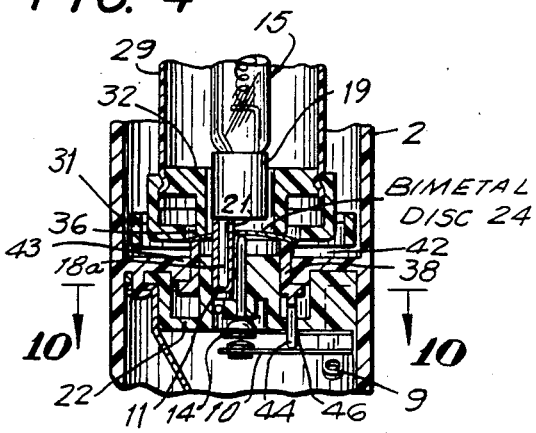
FIG. 4 is a fragmentary vertical cross section similar to FIG. 2 showing the position of the bimetallic thermostatic disc and switch elements after the hair roller has been heated, with the roller still in place.

Referring now to FIG. 4, after sufficient heat is radiated by and/or conducted from heater 15 to various parts of the roller, the thermal energy is transferred by conduction to both the heavy end 28 of the roller body where it is stored, and to the roller end cap member 32 which is positioned to transfer some heat to bimetallic disc 24. When disc 24 reaches its preset avalanche point (at a predetermined temperature) it abruptly reverses its position from concave to convex, thereby providing head-space on the new concave side of disc 24. This permits pin 25 to rise (axially) through the upward force exerted by contact 14, thereby opening contacts 10 and 14 and deenergizing heater 15. At this point, by the audible click of disc 24 or by observing the extinguishing of an optional pilot light connected in parallel with the heater (not shown), the user receives a signal to withdraw the roller which is ready for use. In the event that the roller is left in the hair-setter for a period until sufficient cooling takes place, the system will automatically recycle, reheating the roller. After the roller is installed in the user's hair, latent heat stored in the heavy end 28 of the roller transfers to the relatively thin cylindrical wall of the roller to replace heat lost through conduction to the hair, thus imparting additional useful hair-setting heat.

Referring to FIG. 6, a safety feature is shown which is activated in the event the user elects to improperly use the appliance by holding the roller down even after the automatic heater shutoff takes place. Forcing the roller downwardly until the lower edge of end cap 31 contacts the transverse wall 43 exerts a downward force on tubular member 38 via tube end 36 and disc 24. This downward force is transmitted through pin 44 to the upper surface of contact leaf 10 causing it to move downwardly away from contact 14 thereby opening the electrical circuit and preventing heater 15 from being energized.

Referring again to FIG. 2, the user may prepare hairsetter 1 for use by unreeling line cord 4 by holding lower casing 3 and withdrawing the line cord by pulling on plug 6. The cord passes through slot 7 in the side wall of casing 3 against the opposing torsional forces imparted by clock spring 55, one end of which is anchored in extension clip 56 which is affixed to the upper inside wall of casing 3 and the other end of which is anchored to the upper inner wall of casing 2 (not shown). A conventional gravity type of detent mechanism housed adjacent to the spring (not shown) may be provided to hold the line cord in a desired extended position.

It will be understood by those skilled in the art that numerous other improvements and modifications may be made to the preferred embodiment of the invention disclosed herein without departing from the spirit and scope thereof.

What is claimed is:

1. A hairsetter for heating a single hair roller comprising:

(a) a cylindrical housing for receiving a roller, (b) heating means centrally disposed within said housing, said heating means comprising a high wattage resistance element encapsulated in a quartz envelope, and (c) energizing means operatively connected to said heating means for controlling energization of said heating means from a source of electrical power, said energizing means including means responsive to the weight of the roller for energizing said heating means when said roller is placed in said cylindrical housing and means responsive to the temperature of the roller for terminating energization of said heating means at a predetermined temperature.

2. A hairsetter according to claim 1 wherein said energizing means comprises:

(i) an axially slidable pin slidably movable downwardly in response to the weight of the roller when the latter is placed in said cylindrical housing, (ii) a first spring biased electrical contact means operatively connected to said heating means, and (iii) a second electrical contact means operatively connected to the source of electrical power, said first and second electrical contact means being positioned with respect to each other such that, in the absence of a roller in the cylindrical housing, they are out of contact with each other so that when said slidable pin moves in response to the weight of a roller placed in the housing said pin urges said first electrical contact means into contact with said second electrical contact means to complete an electric circuit that energizes said heating means, and (iv) a bimetallic disc interposed between the upper end of said slidable pin and said roller, said disc being adapted to (a) assume an upwardly concave configuration when unheated in order to transmit the weight of the roller to said pin to urge said first electrical contact means into contact with said second electrical contact means and to (b) assume an upwardly convex configuration at a predetermined temperature to release the pressure on the upper end of said slidable pin caused by the weight of the roller whereby said pin will move upwardly under the spring bias of said first electrical contact means in an axial direction to break the contact between said first and second electrical contacts thus opening said electric circuit and deenergizing said heating means.

3. A hairsetter according to claim 2 wherein said second contact means is resilient and further comprising a safety means for separating said first and second electrical contact means when a roller is urged downwardly with a force greater than its own weight, said safety means comprising: a slidable element movable axially vertically and being urged upwardly by said second electrical contact means, the upper end of said slidable element being positioned to be engaged and moved by said roller when the latter is urged downwardly with said greater force whereby said greater force is transmitted through said slidable element to said second electrical contact means thereby moving same downwardly and separating said first and second electrical contact means from each other.

* * * * *